US006485075B1

(12) United States Patent
McClain

(10) Patent No.: US 6,485,075 B1
(45) Date of Patent: Nov. 26, 2002

(54) GOLF BALL RETRIEVER SYSTEM

(76) Inventor: Frank O. McClain, 315 Fondulac Rd., Avon Park, FL (US) 33825

( * ) Notice: Subject to any disclaimer, the term of this patent is extended or adjusted under 35 U.S.C. 154(b) by 0 days.

(21) Appl. No.: 10/091,910

(22) Filed: Mar. 6, 2002

(51) Int. Cl.[7] ..... A63B 47/02
(52) U.S. Cl. ..... 294/19.2
(58) Field of Search ..... 294/19.1, 19.2, 294/22, 23.5, 24, 26, 66.1, 99.1, 99.2; 56/328.1, 332; 473/286

(56) References Cited

U.S. PATENT DOCUMENTS 2,738,214 A * 3/1956 Zimmers ..... 294/19.2
3,434,753 A * 3/1969 De Croes ..... 294/19.2
3,520,569 A * 7/1970 Anderson ..... 294/19.2
4,077,659 A * 3/1978 Sievers ..... 294/19.2
4,180,288 A * 12/1979 Sievers ..... 294/19.2
4,968,079 A * 11/1990 Burton ..... 294/19.2
5,472,251 A * 12/1995 Deininger ..... 294/19.2

* cited by examiner

*Primary Examiner*—Johnny D. Cherry
(74) *Attorney, Agent, or Firm*—Joseph N. Breaux

(57) ABSTRACT

A golf ball retriever system that includes a hook assembly, constructed from a wire material covered with a rubberized coating to minimize disturbance of the bottom materials of the water hazard so that the water clarity would stay as clear as possible during retrieval of the golf ball. The hook assembly is secured to the end of the telescopically extendable handle that collapses for convenient storage.

1 Claim, 2 Drawing Sheets

GOLF BALL RETRIEVER SYSTEM

TECHNICAL FIELD

The present invention relates to devices and a system for helping golfers to retrieve a golf ball that has landed in a water hazard and more particularly to a golf ball retriever system that includes a telescoping handle assembly including a hand grip attached to a first end of a telescoping section that retracts into a cavity provided within the hand grip and a second end attached to two mirror image, rubberized, metal gripping hook members each having a curved portion that terminates in a prong projecting upwardly from a plane defined by the curved portion at an angle of about forty-five degrees; the two mirror image, rubberized, metal gripping hook members being connected to the second end of the telescoping section such that the prongs define a split opening therebetween that provides an area for receiving a golf ball held within a holding area defined by the two mirror image, rubberized, metal gripping hook members.

BACKGROUND ART

It is often desirable for a golfer to retrieve a golf ball hit into a water hazard because of the expense of the golf ball. It would be desirable, therefore, to have a golf ball retriever system that could be collapsed into a small area for storage when not needed but which could be telescopically extended to a considerable length when needed. In order not to disturb the silt and mud laying at the bottom of the water hazard while attempting to retrieve the golf ball, it would be further benefit to have a golf ball retriever system that included a hook assembly, constructed from a wire material covered with a rubberized coating to minimize disturbance of the bottom materials of the water hazard so that the water clarity would stay as clear as possible during retrieval of the golf ball.

GENERAL SUMMARY DISCUSSION OF THE INVENTION

It is thus an object of the invention to provide a golf ball retriever system that includes a telescoping handle assembly including a hand grip attached to a first end of a telescoping section that retracts into a cavity provided within the hand grip and a second end attached to two mirror image, rubberized, metal gripping hook members each having a curved portion that terminates in a prong projecting upwardly from a plane defined by the curved portion at an angle of about forty-five degrees; the two mirror image, rubberized, metal gripping hook members being connected to the second end of the telescoping section such that the prongs define a split opening therebetween that provides an area for receiving a golf ball held within a holding area defined by the two mirror image, rubberized, metal gripping hook members.

Accordingly, a golf ball retriever system is provided. The golf ball retriever system includes a telescoping handle assembly including a hand grip attached to a first end of a telescoping section that retracts into a cavity provided within the hand grip and a second end attached to two mirror image, rubberized, metal gripping hook members each having a curved portion that terminates in a prong projecting upwardly from a plane defined by the curved portion at an angle of about forty-five degrees; the two mirror image, rubberized, metal gripping hook members being connected to the second end of the telescoping section such that the prongs define a split opening therebetween that provides an area for receiving a golf ball held within a holding area defined by the two mirror image, rubberized, metal gripping hook members.

BRIEF DESCRIPTION OF DRAWINGS

For a further understanding of the nature of objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 2:
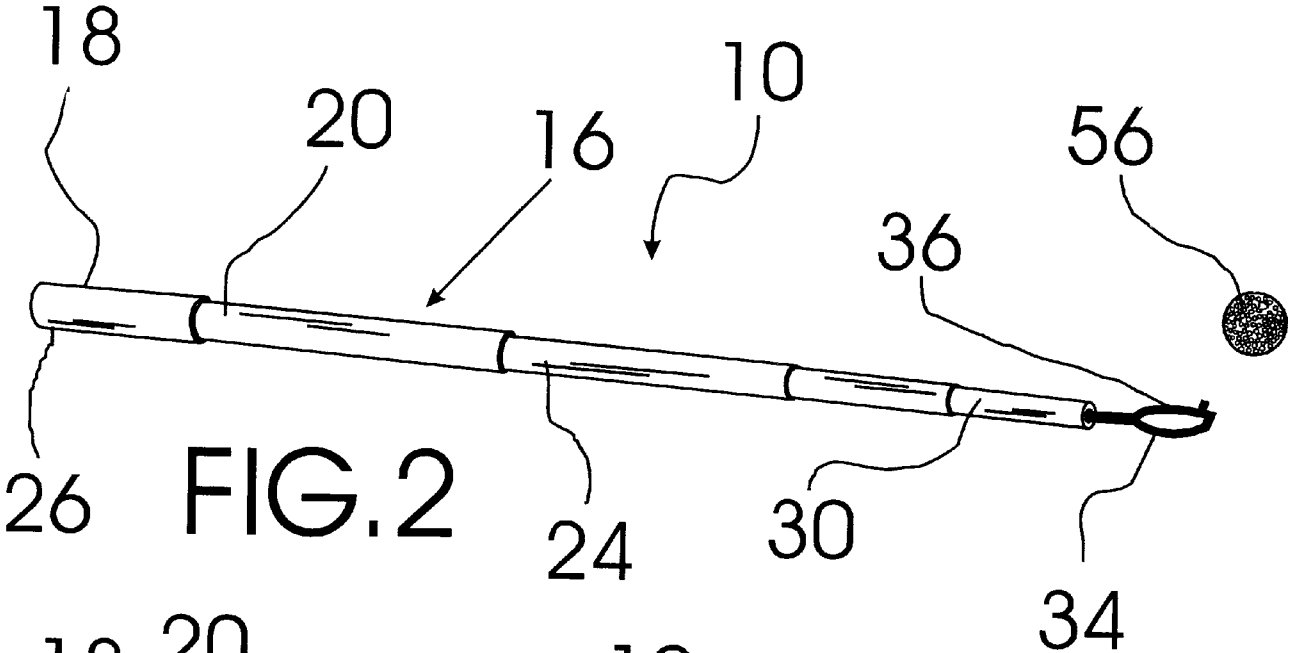
FIG. 2 is a perspective view of the golf ball retriever system of FIG. 1 along with a representative golf ball positioned adjacent to the angled golf ball grabbing hook.
Figure 1:
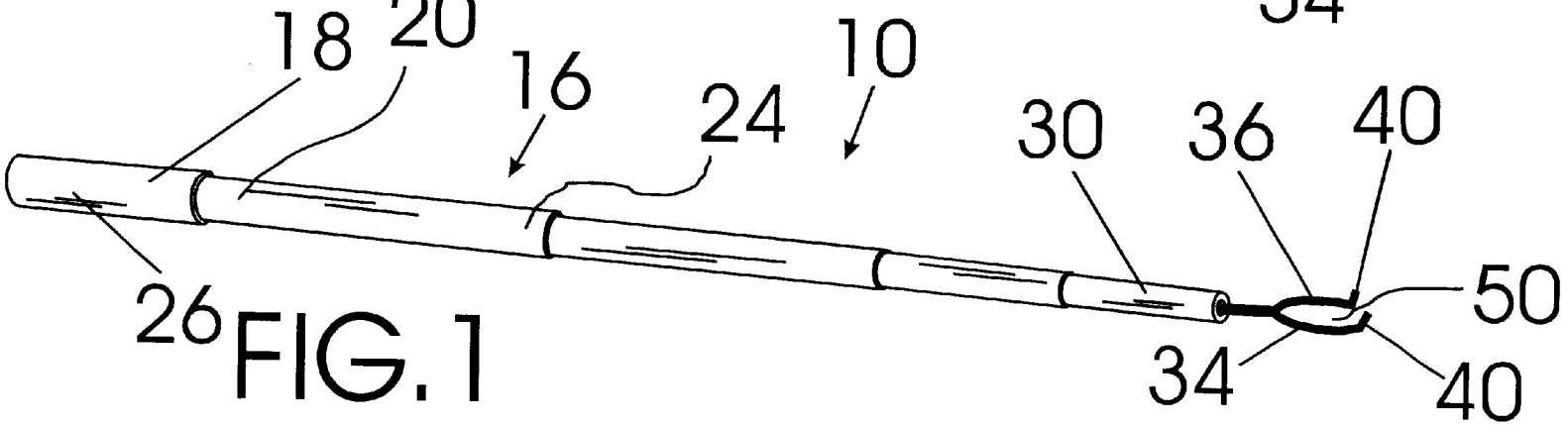
FIG. 1 is a perspective view of an exemplary embodiment of the golf ball retriever system of the present invention.
Figure 3:
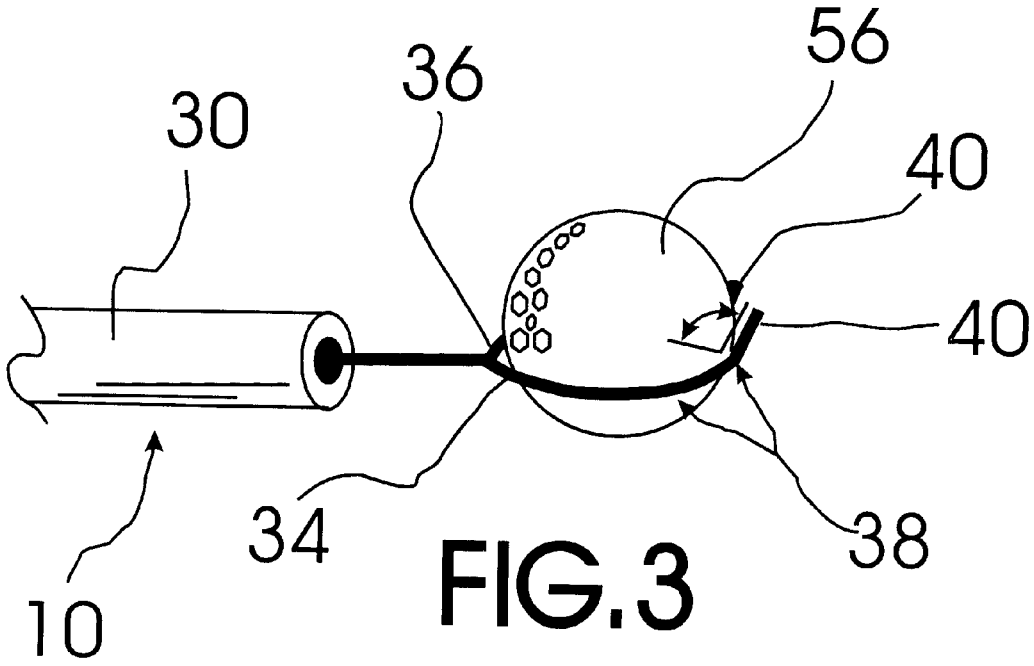
FIG. 3 is a partial perspective view of the golf ball retriever system with the representative golf ball securely gripped by the rubberized, metal gripping hook members.
Figure 4:
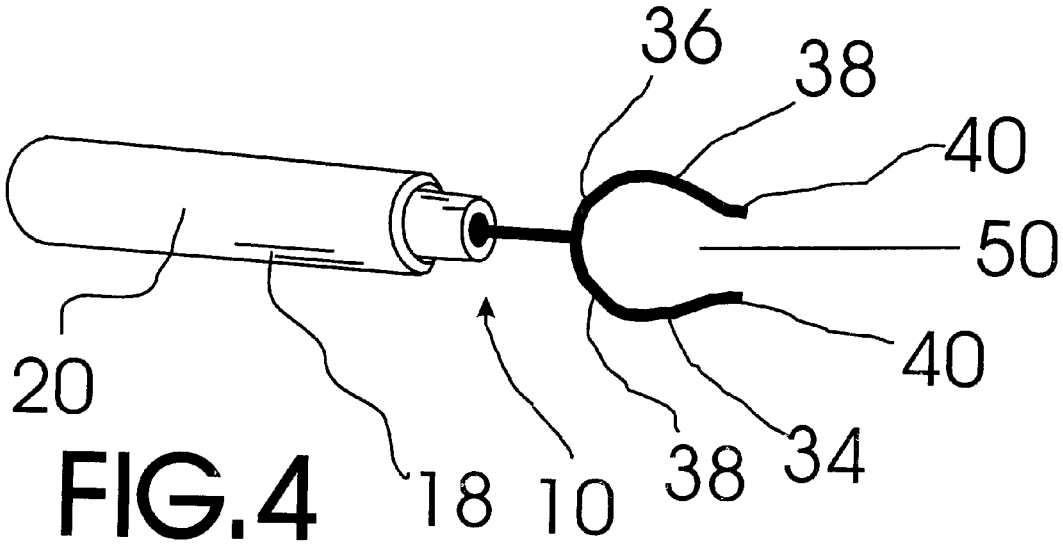
FIG. 4 is a perspective view of the golf ball retriever system of FIG. 1 fully collapsed for storage in a golf bag.

FIGS. 1–4 show various aspects of an exemplary embodiment of the golf ball retriever system of the present invention generally designated 10. Golf ball retriever system 10 is adapted for retrieving golf balls from water hazards and the like. Golf ball retriever system 10 includes a telescoping handle assembly, generally designated 16, including a hand grip 18 attached to a first end 20 of a metal or plastic telescoping assembly 24 that retracts into a cavity 26 provided within hand grip 18 and a second end 30 attached to two mirror image, rubberized, metal gripping hook members, generally designated 34,36, each having a curved portion 38 that terminates in a prong 40 projecting upwardly from a plane defined by the curved portions 34,36 at an angle of about forty-five degrees. The two mirror image, rubberized, metal gripping hook members 34,36 are connected to the second end 30 of the telescoping section 24 such that the prongs 40 define a split opening 50 therebetween that provides an area for receiving a golf ball 56 held within a holding area defined by the two mirror image, rubberized, metal gripping hook members 34,36.

It can be seen from the preceding description that a golf ball retriever system has been provided.

It is noted that the embodiment of the golf ball retriever system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A golf ball retriever system comprising:

a telescoping handle assembly including a hand grip attached at a first end of a telescoping section that retracts into a cavity provided within the hand grip and a second end attached to two mirror image, rubberized, metal gripping hook members, each having a curved portion that terminates in a prong projecting upwardly from a plane defined by the curved portion at an angle of about forty-five degrees;

the two, mirror image, rubberized, metal gripping hook members being connected to the second end of the telescoping section such that the prongs define a split opening therebetween that provides an area for receiving a golf ball held within a holding area defined by the two, mirror image, rubberized, metal gripping hook members.

* * * * *